US011518057B2

(12) United States Patent
Fujita et al.

(10) Patent No.: US 11,518,057 B2
(45) Date of Patent: Dec. 6, 2022

(54) CUTTING APPARATUS

(71) Applicant: DISCO CORPORATION, Tokyo (JP)

(72) Inventors: Tomoya Fujita, Tokyo (JP); Yuichi Kitazumi, Tokyo (JP); Hiroshi Nomura, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/330,705

(22) Filed: May 26, 2021

(65) Prior Publication Data

US 2021/0394384 A1 Dec. 23, 2021

(30) Foreign Application Priority Data

Jun. 22, 2020 (JP) ..... JP2020-107008

(51) Int. Cl.
*B26D 1/15* (2006.01)
*B26D 7/26* (2006.01)
*B26D 7/12* (2006.01)

(52) U.S. Cl.
CPC ..... *B26D 1/15* (2013.01); *B26D 7/12* (2013.01); *B26D 7/2621* (2013.01)

(58) Field of Classification Search
CPC ..... Y10T 83/303; Y10T 83/9377; Y10T 83/9379; Y10T 83/9374; Y10T 83/9403; Y10T 83/9457; Y10T 83/9459; Y10T 83/9464; B26D 1/15; B26D 7/12; B26D 7/2621; B26D 7/26; B26D 7/2614
USPC ..... 125/13.01, 15; 451/342, 359, 360
See application file for complete search history.

(56) References Cited

U.S. PATENT DOCUMENTS 3,908,499 A * 9/1975 Reed ..... B23D 35/004 83/665
5,325,753 A * 7/1994 Schussler ..... B23D 35/008 83/676
6,591,725 B1 * 7/2003 Martin ..... B23D 45/062 83/477.2
2003/0104773 A1 * 6/2003 Krondorfer ..... B24D 9/085 451/342

(Continued)

FOREIGN PATENT DOCUMENTS

JP 2000061804 A 2/2000
JP 2000190155 A 7/2000

(Continued)

OTHER PUBLICATIONS

Search Report issued by the Intellectual Property Office of Singapore in counterpart Patent Application No. 10202105488V, dated Jul. 29, 2022.

*Primary Examiner* — Phong H Nguyen
(74) *Attorney, Agent, or Firm* — Greer Burns & Crain, Ltd.

(57) ABSTRACT

A cutting apparatus includes a chuck table for holding a workpiece thereon, and a cutting unit for cutting the workpiece held on the chuck table. The cutting unit includes a spindle, a mount base fixed to a distal end of the spindle and having an annular coupling face extending around an axis of the spindle and external threads on a distal end portion of the mount base, a ring-shaped ring mount coupled to the coupling face of the mount base and having an annular support surface supporting a surface of an annular base of a hub blade, a coupling mechanism coupling the ring mount to the coupling face of the mount base, and a nut threaded over the external threads of the mount base.

5 Claims, 11 Drawing Sheets

(56) References Cited

U.S. PATENT DOCUMENTS

2016/0059370 A1* 3/2016 Matsuyama ..... B23D 59/025
409/136

FOREIGN PATENT DOCUMENTS

JP 2015-089606 A 5/2015
JP 2019150906 A 9/2019

* cited by examiner

CUTTING APPARATUS

BACKGROUND OF THE INVENTION

Field of the Invention

The present invention relates to a cutting apparatus.

Description of the Related Art

As disclosed in JP 2019-150906 A, JP 2000-190155 A, and JP 2000-061804 A, a cutting apparatus cuts a wafer held on a chuck table using a hub blade fixed to a distal end of a spindle and rotated about its central axis by rotating the spindle.

The hub blade includes an annular grindstone that is fabricated by electrodepositing abrasive grits on an outer circumferential portion of an annular aluminum base and then removing the outer circumferential portion of the annular aluminum base, leaving the electrodeposited abrasive grits as the annular grindstone. Therefore, no coating or the like is applied to the annular aluminum base.

For installing the hub blade on the spindle, the hub blade is placed on a mount fixed to the distal end of the spindle, and then a nut is threaded over a distal end of the mount, thereby gripping and securing in place the aluminum base between the nut and the mount.

SUMMARY OF THE INVENTION

The hub blade mounted on the spindle may cause fragments of aluminum to be left on the mount. When another cutting blade is placed on the mount with aluminum fragments left thereon, the cutting blade tends to be shifted off-center. When the cutting blade thus mounted is rotated about its central axis to cut a wafer on the chuck table, kerfs formed in the wafer by the cutting blade are likely to become wider.

One solution to the above problem is to perform an end face correcting process for grinding a support end face of the mount with a grindstone to remove aluminum fragments from the support end face of the mount. However, the end face correcting process is time-consuming because it includes a number of steps, i.e., installing a grindstone for grinding the support end face of the mount on the chuck table, moving the spindle in an axial direction thereof to bring the support end face of the mount into contact with the grindstone, and moving the mount and the grindstone relatively to each other in directions parallel to the support end face of the mount.

It is therefore an object of the present invention to provide a cutting apparatus that is capable of simply solving problems caused by fragments of aluminum attached to a mount base for a hub blade.

In accordance with an aspect of the present invention, there is provided a cutting apparatus including a chuck table for holding a workpiece thereon, and a cutting unit, on which a hub blade can be mounted, for cutting the workpiece held on the chuck table, the hub blade having an annular base with an opening defined centrally therein and an annular grindstone fixed to an outer circumferential edge of the annular base, and the cutting unit includes a spindle, a mount base fixed to a distal end of the spindle and having an annular coupling face extending around an axis of the spindle and external threads on a distal end portion of the mount base, a ring-shaped ring mount coupled to the coupling face of the mount base and having an annular support surface supporting a surface of the annular base of the hub blade, a coupling mechanism coupling the ring mount to the coupling face of the mount base, and a nut threaded over the external threads of the mount base, and the annular base of the hub blade is sandwiched in place between the nut threaded over the external threads of the mount base and the ring mount.

Preferably, the coupling mechanism includes a pin including a neck projecting from the coupling face of the mount base in an axial direction of the spindle and a head disposed on a distal end of the neck, a hole defined in the ring mount for receiving the head of the pin inserted therein, and an arcuate oblong hole defined in the ring mount for receiving the neck of the pin inserted therein to allow the ring mount and the mount base to turn relatively to each other around the axis of the spindle with the pin inserted in the hole and the arcuate oblong hole, the arcuate oblong hole extending from the hole in a direction along which the ring mount is angularly movable with respect to the mount base, the arcuate oblong hole having a width smaller than a diameter of the hole, and the mount base and the ring mount are coupled to each other by inserting the pin into the hole defined in the ring mount and angularly moving the ring mount and the mount base relatively to each other.

Preferably, the coupling mechanism includes a magnet disposed on either the ring mount or the mount base, and a magnetic member disposed on either the mount base or the ring mount that is free of a magnet, and the ring mount is coupled to the mount base under magnetic forces.

Preferably, the coupling mechanism includes magnets disposed respectively on the ring mount and the mount base, and the ring mount is coupled to the mount base under magnetic forces.

Preferably, the coupling mechanism includes an inner wall support supporting an annular inner circumferential wall surface of the ring mount, and the ring mount is coupled to the coupling face of the mount base by the inner wall support.

According to the aspect of the present invention described above, the ring mount having the annular support surface that supports the hub blade on the mount base is removable from the mount base. When fragments of aluminum from the annular base of the hub blade are attached to the ring mount, only the ring mount is detached and replaced with a new one. Therefore, the cutting apparatus is capable of simply solving problems which would otherwise be caused if aluminum fragments were attached to the mount base. Specifically, the hub blade can be prevented from being shifted off-center by aluminum fragments which would otherwise be attached to the mount base and hence from cutting wider kerfs in workpieces on the cutting apparatus.

Since the hub blade is secured to the mount base with the ring mount interposed therebetween, aluminum fragments are attached from the hub blade to the ring mount. The ring mount can be removed, aluminum fragments attached to the ring mount can be removed, and the ring mount thus cleaned can be used again. Furthermore, as the ring mount is coupled to the mount base, the hub blade can be installed in place in a manner similar to the conventional installing process.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A preferred embodiment of the present invention will be described hereinbelow with reference to the accompanying drawings.

1. Structure of Cutting Apparatus

Figure 1:
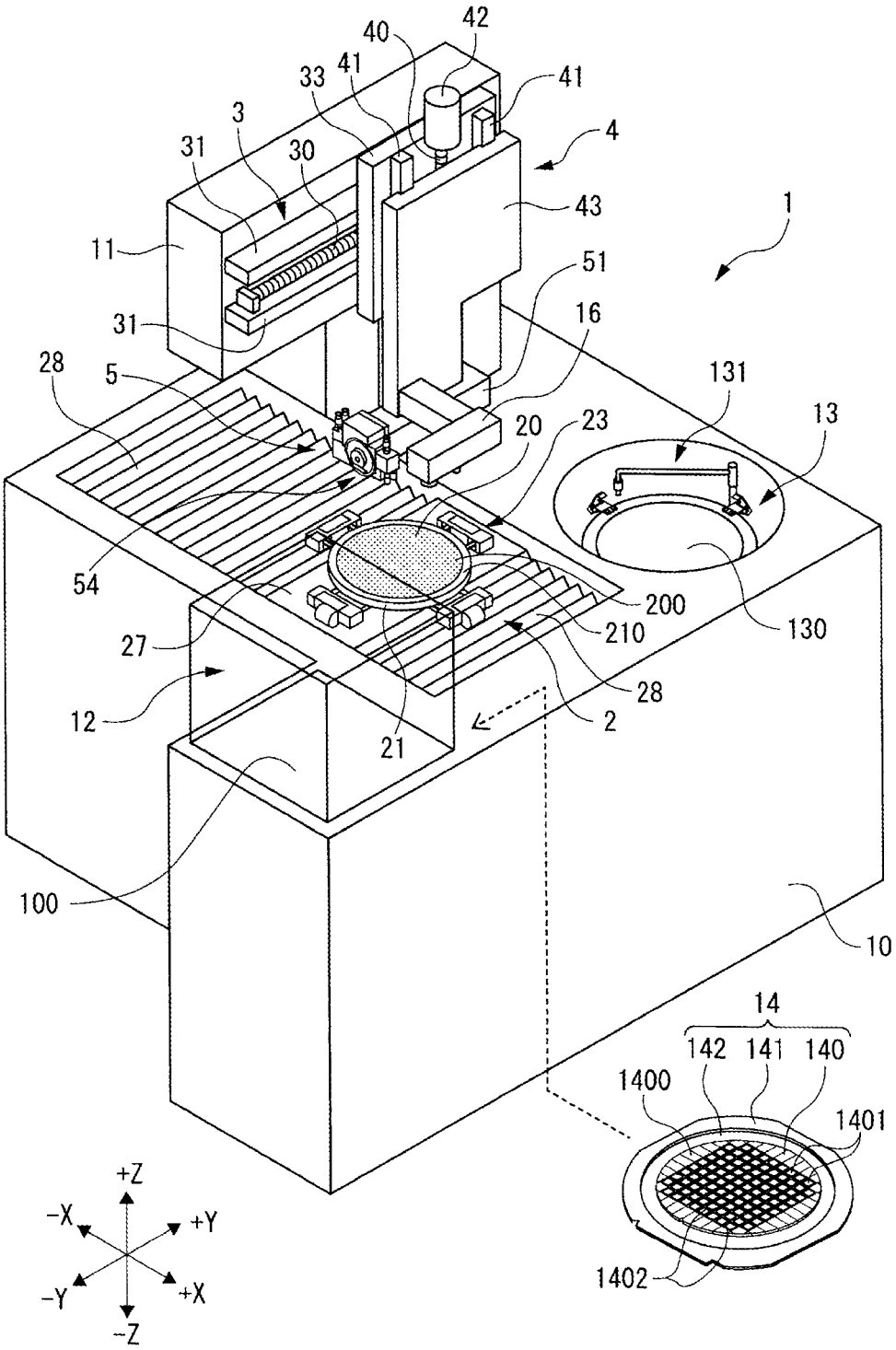
FIG. 1 is a perspective view of a cutting apparatus according to an embodiment of the present invention.

FIG. 1 illustrates in perspective a cutting apparatus 1 according to a preferred embodiment of the present invention. As illustrated in FIG. 1, there is established an XYZ coordinate system having an X-axis, a Y-axis, and a Z-axis with respect to the cutting apparatus 1. The X-axis is defined along opposite +X and −X directions that are also referred to as X directions. The Y-axis is defined along opposite +Y and −Y directions that are also referred to as Y directions that extend perpendicularly to the X directions. The Z-axis is defined along opposite +Z and −Z directions that are also referred to as Z directions that extend perpendicularly to the X directions and the Y directions.

The cutting apparatus 1 is an apparatus for cutting a workpiece 140 using a cutting unit, i.e., cutting means, 5. The workpiece 140 is positioned within an annular frame 141 and a tape 142 is affixed to a lower surface of the frame 141 and a lower surface of the workpiece 140, providing a workpiece unit 14 where the workpiece 140, the frame 141, and the tape 142 are integrally combined with each other. The workpiece 140 has an upper surface 1400 on which a plurality of projected dicing lines 1402 are formed in two groups perpendicular to each other. A plurality of devices 1401 are disposed in respective areas demarcated on the upper surface 1400 by the projected dicing lines 1402. The structural details of the cutting apparatus 1 will be described hereinbelow.

As illustrated in FIG. 1, the cutting apparatus 1 has a base 10 in the form of a block that is substantially L-shaped as viewed in plan. The base 10 includes a cassette stage 100 positioned at a corner thereof in the +X direction and the −Y direction, and a cassette 12 is placed on the cassette stage 100. The cassette 12 houses a plurality of workpiece units 14 therein.

A chuck table 2 is disposed on the base 10. The chuck table 2 includes a suction portion 20 shaped as a circular plate and an annular frame 21 supporting the suction portion 20. The suction portion 20 has an upper surface acting as a holding surface 200 for holding a workpiece unit 14 thereon.

Four clamps 23 are disposed at respective equally angularly spaced positions adjacent to the chuck table 2 and around the chuck table 2. The workpiece unit 14 placed on the holding surface 200 has its frame 141 gripped by the four clamps 23, so that the workpiece unit 14 is securely held on the chuck table 2.

The chuck table 2 is connected to a rotating mechanism, i.e., rotating means, not depicted. The chuck table 2 can be rotated about its central vertical axis by the rotating mechanism.

The chuck table 2 is also connected to a horizontal moving mechanism, i.e., an X-axis moving mechanism or horizontal moving means, not depicted. The chuck table 2 can be moved horizontally along the X-axis by the horizontal moving mechanism. When the workpiece 140 is held on the holding surface 200 of the chuck table 2 and the chuck table 2 is moved horizontally along the X-axis by use of the horizontal moving mechanism, the workpiece 140 can be moved horizontally along the X-axis in unison with the chuck table 2.

A cover 27 is disposed beneath and around the chuck table 2 and coupled to bellows 28 that is extensible and contractible along the X-axis.

When the chuck table 2 is moved along the X-axis, the cover 27 is also moved along the X-axis in unison with the chuck table 2, extending or contracting the bellows 28.

A cleaning unit, i.e., cleaning means, 13 for cleaning a workpiece 140 that has been cut is positioned at a corner of the base 10 in the +X direction and the +Y direction. The cleaning unit 13 includes a spinner table 130 for holding the workpiece 140 thereon and a cleaning nozzle 131 for ejecting cleaning water toward an upper surface of the spinner table 130.

While the workpiece 140 is being held on the upper surface of the spinner table 130, the spinner table 130 is rotated, and the cleaning nozzle 131 ejects cleaning water to clean the workpiece 140 with running water.

An L-shaped column 11 is erected on the base 10 at a position spaced from the cleaning unit 13 in the −X direction. A Y-axis moving mechanism, i.e., Y-axis moving means, 3 for moving a cutting unit 5 along the Y-axis is disposed on a side surface of the L-shaped column 11 that faces in the +X direction.

The Y-axis moving mechanism 3 includes a ball screw 30 extending along the Y-axis, a Y-axis motor, not depicted, for rotating the ball screw 30 about its central axis, a pair of guide rails 31 disposed parallel to the ball screw 30 one on each side thereof, and a movable plate 33 having a side surface supporting a nut, not depicted, operatively threaded over the ball screw 30 and held in sliding contact with the guide rails 31.

When the Y-axis motor not depicted is energized to rotate the ball screw 30 about its central axis, the movable plate 33 is moved horizontally along the Y-axis while being guided by the guide rails 31. When the movable plate 33 is moved horizontally along the Y-axis, the cutting unit 5 is also moved horizontally along the Y-axis in unison with the movable plate 33.

A Z-axis moving mechanism, i.e., Z-axis moving means, 4 for moving the cutting unit 5 along the Z-axis is disposed on a side surface of the movable plate 33 that faces in the +X direction. The Z-axis moving mechanism 4 includes a ball screw 40 extending along the Z-axis, a Z-axis motor 42 for rotating the ball screw 40 about its central axis, a pair of guide rails 41 disposed parallel to the ball screw 40 one on each side thereof, and a vertically movable plate 43 having a side surface supporting a nut, not depicted, operatively threaded over the ball screw 40 and held in sliding contact with the guide rails 41. The cutting unit 5 is supported on the vertically movable plate 43.

When the Z-axis motor is energized to rotate the ball screw 40 about its central axis, the vertically movable plate 43 is moved vertically along the Z-axis while being guided by the guide rails 41. When the vertically movable plate 43 is moved vertically along the Z-axis, the cutting unit 5 supported on the vertically movable plate 43 can also be moved vertically along the Z-axis in unison with the vertically movable plate 43.

An image capturing unit, i.e., image capturing means, 16 is supported on a side surface of the vertically movable plate 43 that faces in the +X direction. The image capturing unit 16 captures an image of projected dicing lines 1402 of the workpiece 140. It is possible to position the cutting unit 5 with respect to the workpiece 140 on the basis of the captured image of the projected dicing lines 1402.

Figure 2:
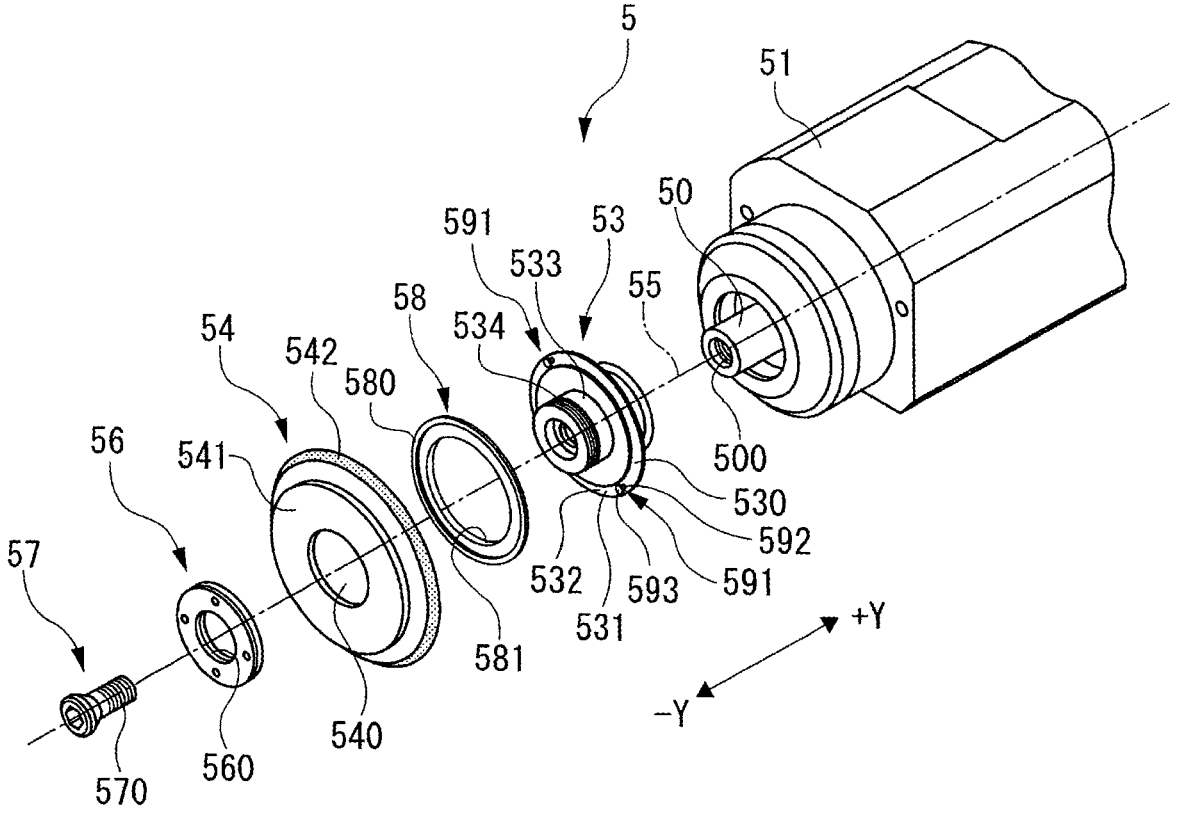
FIG. 2 is an explosive perspective view of a cutting unit of the cutting apparatus.

As illustrated in FIG. 2, the cutting unit 5 includes a spindle 50, a mount base 53 fixed to a distal end of the spindle 50, a ring mount 58 coupled to a coupling face 532 of the mount base 53, a nut 56 pressing a hub blade 54 mounted on the mount base 53 against the mount base 53, and a retainer 57 retaining the mount base 53 on the spindle 50. The hub blade 54 can be mounted on the mount base 53 with the ring mount 58 interposed therebetween.

The spindle 50 is of a cylindrical shape, for example, and is housed in and protected by a spindle housing 51. The spindle 50 is connected to an electric motor, not depicted, that rotates the spindle 50 about an axis 55 extending along the Y-axis. The spindle 50 has internal threads 500 formed in the distal end portion thereof.

The hub blade 54 includes an annular base 541 of aluminum that has an opening 540 defined centrally therein and an annular grindstone 542 fixed to an outer circumferential edge portion of the annular base 541. The grindstone 542 is made of abrasive grits electrodeposited on the outer circumferential edge portion of the annular base 541.

The mount base 53 includes a flange 530 shaped as a circular plate and a cylindrical boss 533 disposed centrally on the flange 530 and protruding therefrom in the −Y direction.

Figure 3:
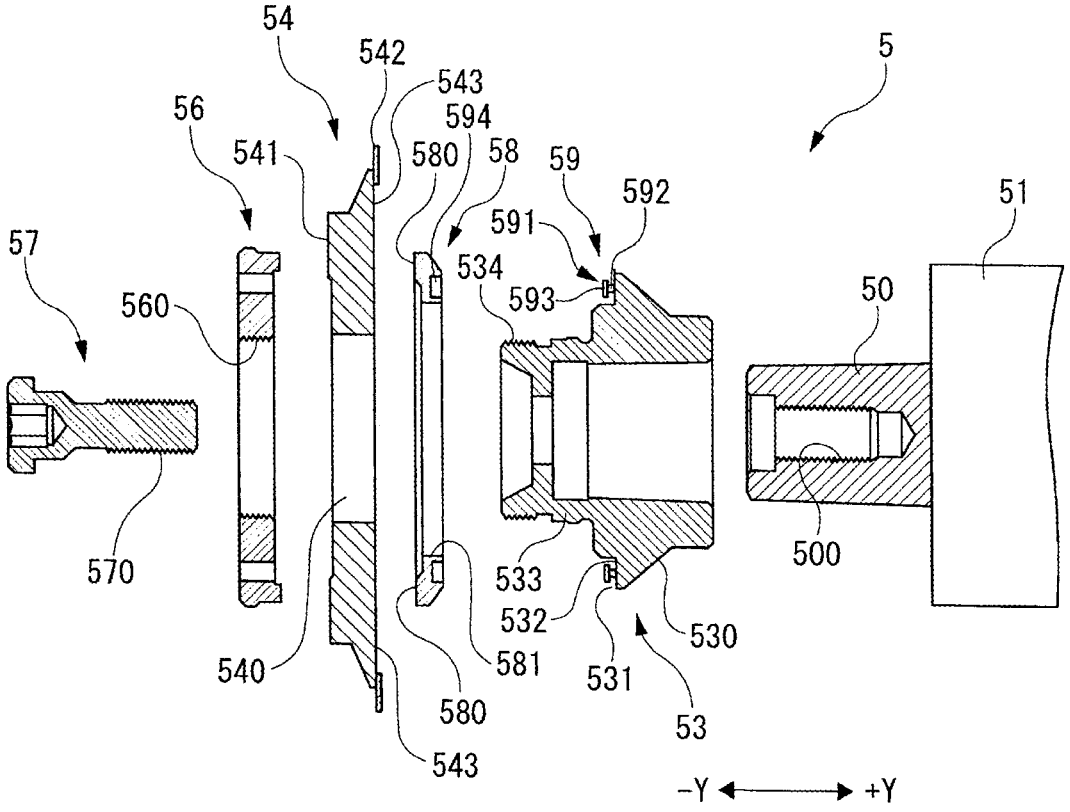
FIG. 3 is an explosive cross-sectional view of the cutting unit.

As illustrated in FIG. 3, the flange 530 has a recess 531 that is defined in a radially outermost circumferential portion thereof and that is recessed in the +Y direction. The recess 531 has a bottom surface facing in the −Y direction and acting as an annular coupling face 532 to which the ring mount 58 is coupled. The coupling face 532 has a central axis aligned with the axis 55 of the spindle 50 illustrated in FIG. 2. The boss 533 has external threads 534 formed on an outer circumferential surface of a distal end portion thereof.

The ring mount 58 is in the form of a ring-shaped metal member and has an annular support surface 580 supporting a supported face 543 that is one of the axially opposite surfaces of the annular base 54 and a coupled face 582 (see FIG. 4) facing the coupling face 532.

The nut 56 has internal threads 560 formed in an inner circumferential surface thereof for threaded engagement with the external threads 534 of the mount base 53. The retainer 57 has also external threads 570 formed on an outer circumferential surface thereof for threaded engagement with the internal threads 500 of the spindle 50.

As illustrated in FIG. 3, the cutting unit 5 includes a coupling mechanism 59 for coupling the ring mount 58 to the coupling face 532. The coupling mechanism 59 includes, for example, two pins 591 each having a neck 592 protruding from the coupling face 532 of the mount base 53 in a direction, i.e., the −Y direction, along the axis 55 of the spindle 50 and a head 593 disposed on a distal end of the neck 592.

The two pins 591 are disposed at equal spaced intervals on the circumference of the coupling face 532 of the mount base 53, for example. The two pins 591 are fixed to the coupling face 532 of the mount base 53 such that a straight line joining the two pins 591 extends through the center of the coupling face 532 of the mount base 53. Outside diameters of the heads 593 of the pins 591 are larger than outside diameters of the necks 592.

Figure 4:
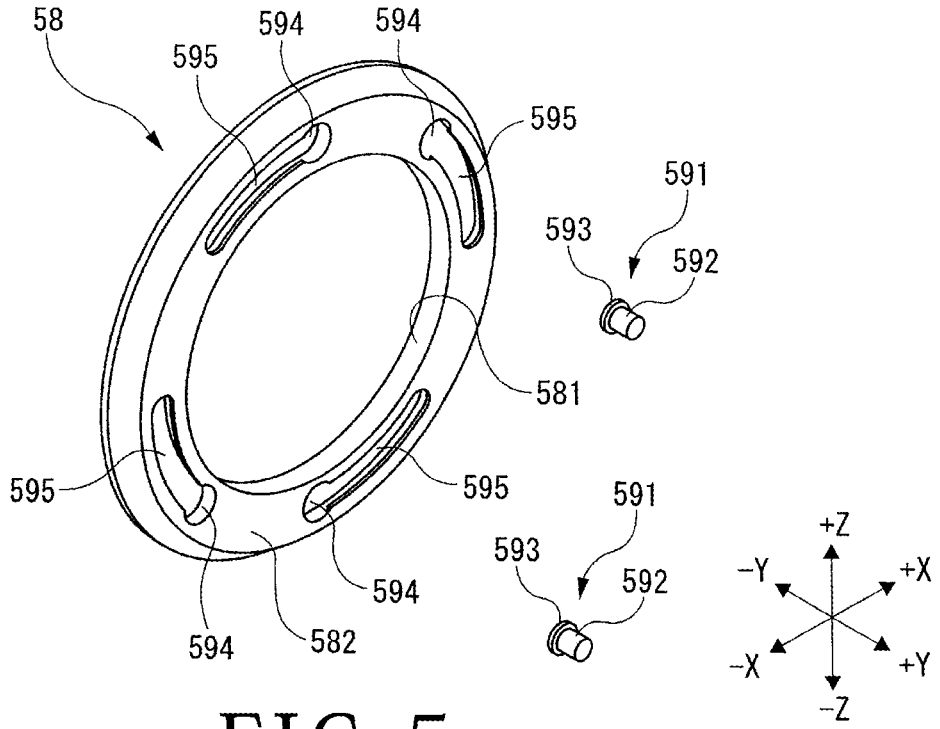
FIG. 4 is a perspective view of a ring mount of the cutting unit.

As illustrated in FIG. 4, the coupling mechanism 59 also includes four circular holes 594 defined in the ring mount 58 and four oblong holes 595 defined in the ring mount 58 and extending arcuately from the respective circular holes 594 in a direction along which the ring mount 58 is angularly movable with respect to the mount base 53. The circular holes 594 and the oblong holes 595 are recessed from the coupled face 582 of the ring mount 58 in a thicknesswise direction, i.e., the −Y direction, of the ring mount 58. The four circular holes 594 and the four oblong holes 595 are disposed at equal spaced intervals on the circumference of the ring mount 58.

Figure 5:
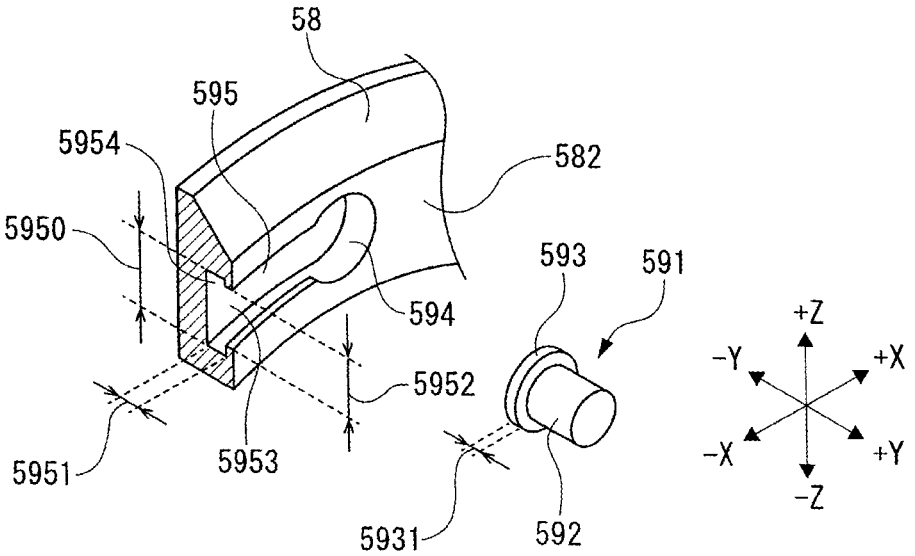
FIG. 5 is an enlarged fragmentary perspective view of the ring mount.

FIG. 5 illustrates fragmentarily in enlarged scale the ring mount 58 and one of the pins 591 in order to indicate structural details of each of the circular holes 594 and the oblong holes 595. As illustrated in FIG. 5, the circular hole 594 has a diameter large enough for the head 593 of the pin 591 to be inserted therein and a depth along the Y-axis large enough to accommodate the head 593 and the neck 592 therein. A width of the oblong hole 595 across an arcuate direction thereof is smaller than a diameter of the circular hole 594.

The oblong hole 595 includes a neck slide groove 5953 closer to the coupled face 582 and a head slide groove 5954 deeper away from the neck slide groove 5953 in the thicknesswise direction, i.e., the −Y direction, of the ring mount 58. The head slide groove 5954 has a width represented by a first length 5950, whereas the neck slide groove 5953 has a width represented by a second length 5952. The first length 5950 is slightly larger than a diameter of the head 593 that is of a circular shape, whereas the second length 5952 is smaller than the diameter of the head 593 and slightly larger than a diameter of the neck 592 that is of a cylindrical shape.

The head slide groove 5954 has a depth represented by a length 5951 slightly larger than a thickness, denoted by 5931, of the head 593.

The coupling mechanism 59 that includes the pins 591 and the circular hole 594 and the oblong hole 595 in which the pins 591 engage acts like a hooked ceiling lighting attachment.

Figure 6:
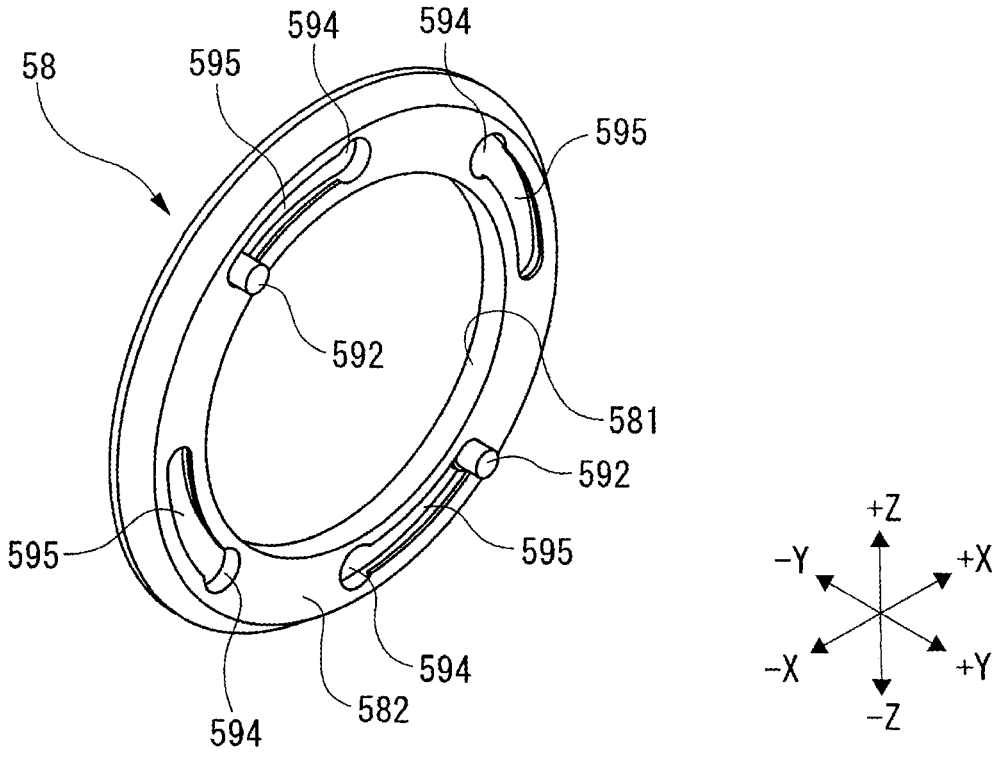
FIG. 6 is a perspective view illustrating a manner in which pins are inserted into the ring mount and the ring mount is turned.
Figure 7:
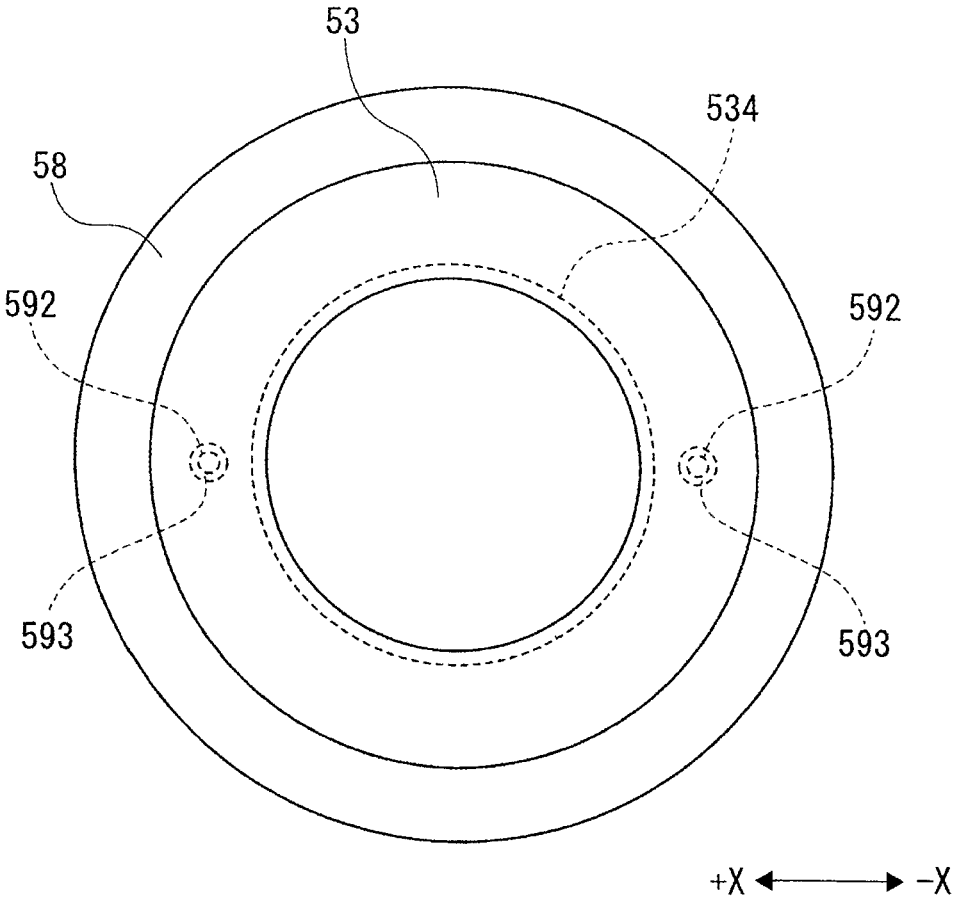
FIG. 7 is a front elevational view illustrating a manner in which a mount base is coupled to the ring mount by a coupling mechanism.

For coupling the ring mount 58 and the mount base 53 to each other, the heads 593 and the necks 592 of the pins 591 illustrated in FIG. 4 are inserted into two of the circular holes 594 in the ring mount 58, and then the ring mount 58 is turned relatively to the mount base 53. Then, as illustrated in FIG. 6, the heads 593 of the pins 591 slide through the respective head slide grooves 5954 of the oblong holes 595 until they reach ends of the oblong holes 595 away from the circular holes 594. Now, the ring mount 58 is fixed to the mount base 53 as illustrated in FIG. 7. At this time, since the second length 5952 of the oblong holes 595 is smaller than the diameter of the heads 593 of the pins 591 as illustrated in FIG. 5, the pins 591 are prevented from being dislodged from the oblong holes 595 in the +Y direction.

The numbers of the pins 591, the circular holes 594, and the oblong holes 595 of the coupling mechanism 59 are not limited to the illustrated numbers.

Figure 8:
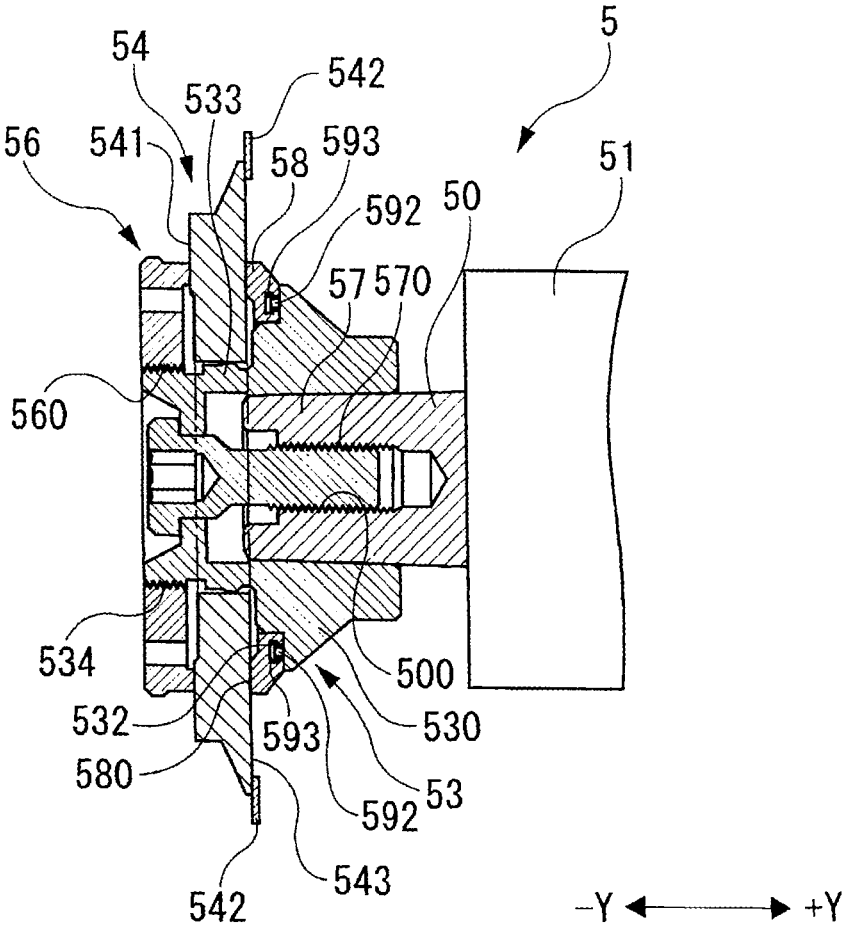
FIG. 8 is a cross-sectional view of the cutting unit.

FIG. 8 illustrates a manner in which the various components of the cutting unit 5 are combined in interfitting relation. In FIG. 8, the ring mount 58 is coupled to the mount base 53, and the mount base 53 is fixed to the distal end of the spindle 50. In addition, the annular base 541 of the hub blade 54 is fitted over the boss 533 of the mount base 53 and supported on the support surface 580 of the ring mount 58. The hub blade 54 is also held in place by the nut 56 pressed against a surface of the annular base 541 that is opposite the support surface 580 of the ring mount 58 in the −Y direction. The internal threads 560 of the nut 56 are held in threaded engagement with the external threads 534 of the boss 533. In other words, the hub blade 54 is sandwiched in place between the ring mount 58 and the nut 56. Then, the retainer 57 is inserted axially through the boss 533 of the mount base 53 into the spindle 50, bringing the external threads 570 of the retainer 57 into threaded engagement with the internal threads 500 of the spindle 50 thereby to combine the mount base 53, the hub blade 54, and the nut 56 integrally together.

2. Operation of Cutting Apparatus

Operation of the cutting apparatus 1 for cutting the workpiece 140 will be described hereinbelow.

For cutting the workpiece 140 by use of the cutting apparatus 1, one of the workpiece units 14 housed in the cassette 12 illustrated in FIG. 1 is removed and placed on the holding surface 200 of the chuck table 2. The four clamps 23 at the four equally angularly spaced positions clamp the frame 141 of the workpiece unit 14, securing the workpiece unit 14 to the chuck table 2. The workpiece 140 is thereby held under suction on the holding surface 200 of the chuck table 2.

Next, while the workpiece 140 is being held on the holding surface 200 of the chuck table 2, the horizontal moving mechanism, not depicted, is actuated to move the chuck table 2 in the −X direction to position the workpiece 140 below the image capturing unit 16. The image capturing unit 16 then captures an image of projected dicing lines 1402 of the workpiece 140. On the basis of the captured image of projected dicing lines 1402, the Y-axis moving mechanism 3 is appropriately actuated to move the cutting unit 5 along the Y-axis to position the cutting unit 5 into alignment with one of the projected dicing lines 1402 across the Y-axis in a position for starting a cutting cycle.

The electric motor, not depicted, connected to the spindle 50, not depicted in FIG. 1, that is housed in the spindle housing 51 is energized to rotate the spindle 50 about its central axis, causing the hub blade 54 to rotate about its central axis.

While the hub blade 54 is being rotated, the Z-axis moving mechanism 4 is actuated to move the cutting unit 5 in the −Z direction to bring the rotating hub blade 54 into contact with the workpiece 140 along the projected dicing line 1402 aligned with the cutting unit 5, and the horizontal moving mechanism is actuated to move the workpiece 140 held on the chuck table 2 in the −X direction. The workpiece 140 and the hub blade 54 are now moved relatively to each other along the X-axis, causing the hub blade 54 to cut the workpiece 140 along the projected dicing line 1402.

After the hub blade 54 has cut the workpiece 140 along the projected dicing line 1402, the Z-axis moving mechanism 4 is actuated to lift the cutting unit 5 in the +Z direction to retract the hub blade 54 upwardly away from the workpiece 140. Then, the horizontal moving mechanism is actuated to move the chuck table 2 in the +X direction into another position for starting a cutting cycle.

The Y-axis moving mechanism 3 is actuated to move the cutting unit 5 along the Y-axis by a distance equal to the distance between adjacent ones of the projected dicing lines 1402, thereby positioning the cutting unit 5 in alignment with a next projected dicing line 1402. Then, the hub blade 54 is caused to cut into the workpiece 140 along the next projected dicing line 1402.

In this manner, the cutting unit 5 cuts the workpiece 140 successively along all the projected dicing lines 1402 belonging to one group extending in the same direction. Thereafter, the rotating mechanism, not depicted, connected to the chuck table 2 is actuated to turn the chuck table 2 about its central axis through 90 degrees, for example. Then, the above cutting process is performed again on the workpiece 140 to cut the workpiece 140 successively along all the projected dicing lines 1402 belonging to another group extending in the same direction. In this fashion, the workpiece 140 is cut along all the projected dicing lines 1402 thereof.

As illustrated in FIG. 8, since the cutting unit 5 of the cutting apparatus 1 includes the ring mount 58 disposed between the annular base 541 of the hub blade 54 and the mount base 53, the annular base 541 leaves aluminum fragments on the ring mount 58. Therefore, such aluminum fragments can be prevented from being attached to the coupling face 532 of the mount base 53.

Heretofore, it has been customary to replace the mount base 53 after the cutting apparatus 1 has performed its cutting process a predetermined number of times. According to the present invention, the ring mount 58 is replaced with a new one after the cutting apparatus 1 has performed its cutting process a predetermined number of times. Since the ring mount 58 is more inexpensive than the mount base 53, the cutting apparatus 1 is more economical as the ring mount 58 can be replaced less costly.

Alternatively, the ring mount 58 can be removed, cleaned, and used again after the cutting apparatus 1 has performed its cutting process a predetermined number of times using the cutting unit 5.

Figure 9:
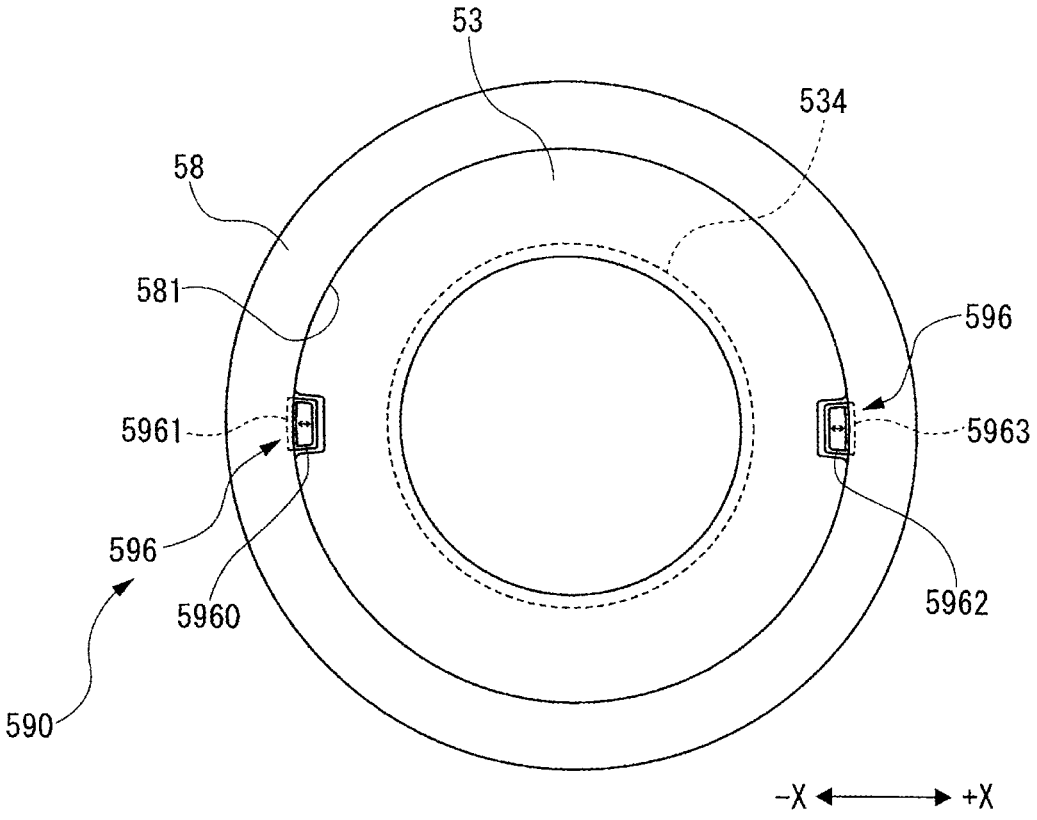
FIG. 9 is a front elevational view illustrating a manner in which the mount base is coupled to the ring mount by another coupling mechanism.

The cutting apparatus 1 may incorporate a second coupling mechanism 590 having two inner wall supports 596 as illustrated in FIG. 9, instead of the coupling mechanism 59 described above. Each of the inner wall supports 596 has a first knob 5960 disposed on an outer circumferential portion of the mount base 53, a first support member 5961 supporting the first knob 5960, a second knob 5962 disposed on an outer circumferential portion of the mount base 53 opposite the first knob 5960 diametrically across the center of the mount base 53, and a second support member 5963 supporting the second knob 5962. The first knob 5960 and the second knob 5962 are positioned such that a straight line joining the first knob 5960 and the second knob 5962 extends through the center of the mount base 53.

Each of the first knob 5960 and the second knob 5962 incorporates therein a spring mechanism or the like, not depicted.

When no external force is applied to the first knob 5960, the first support member 5961 protrudes from an outer circumferential edge of the mount base 53 in the −X direction. The first knob 5960 and the first support member 5961 are now in their home position under the spring force from the spring mechanism incorporated in the first knob 5960. When an external force is applied to the first knob 5960 in the +X direction, pushing the first knob 5960 in the +X direction, the first support member 5961 is moved in the +X direction and housed in the mount base 53. When the external force applied in the +X direction is removed from the first knob 5960, the first knob 5960 and the first support member 5961 are moved in the −X direction back to their home position under the spring force.

Similarly, when no external force is applied to the second knob 5962, the second support member 5963 protrudes from the outer circumferential edge of the mount base 53 in the +X direction. The second knob 5962 and the second support member 5963 are now in their home position under the spring force from the spring mechanism incorporated in the second knob 5962. When an external force is applied to the second knob 5962 in the −X direction, pushing the second knob 5962 in the −X direction, the second support member 5963 is moved in the −X direction and housed in the mount base 53. When the external force applied in the −X direction is removed from the second knob 5962, the second knob 5962 and the second support member 5963 are moved in the +X direction back to their home position under the spring force.

In FIG. 9, the first support member 5961 protrudes from the outer circumferential edge of the mount base 53 in the −X direction, and similarly the second support member 5963 protrudes from the outer circumferential edge of the mount base 53 in the +X direction. The ring mount 58 has an annular inner wall surface 581 pressed and supported by the first support member 5961 and the second support member 5963, so that the mount base 53 and the ring mount 58 are coupled to each other.

For replacing the ring mount 58, for example, the ring mount 58 needs to be dislodged from the mount base 53. To dislodge the ring mount 58, the first knob 5960 is pushed in the +X direction to house the first support member 5691 in the mount base 53, and the second knob 5962 is pushed in the −X direction to house the second support member 5693 in the mount base 53. The annular inner wall surface 581 of the ring mount 58 is now released from the first support member 5961 and the second support member 5963, allowing the ring mount 58 to be detached from the mount base 53.

Figure 10:
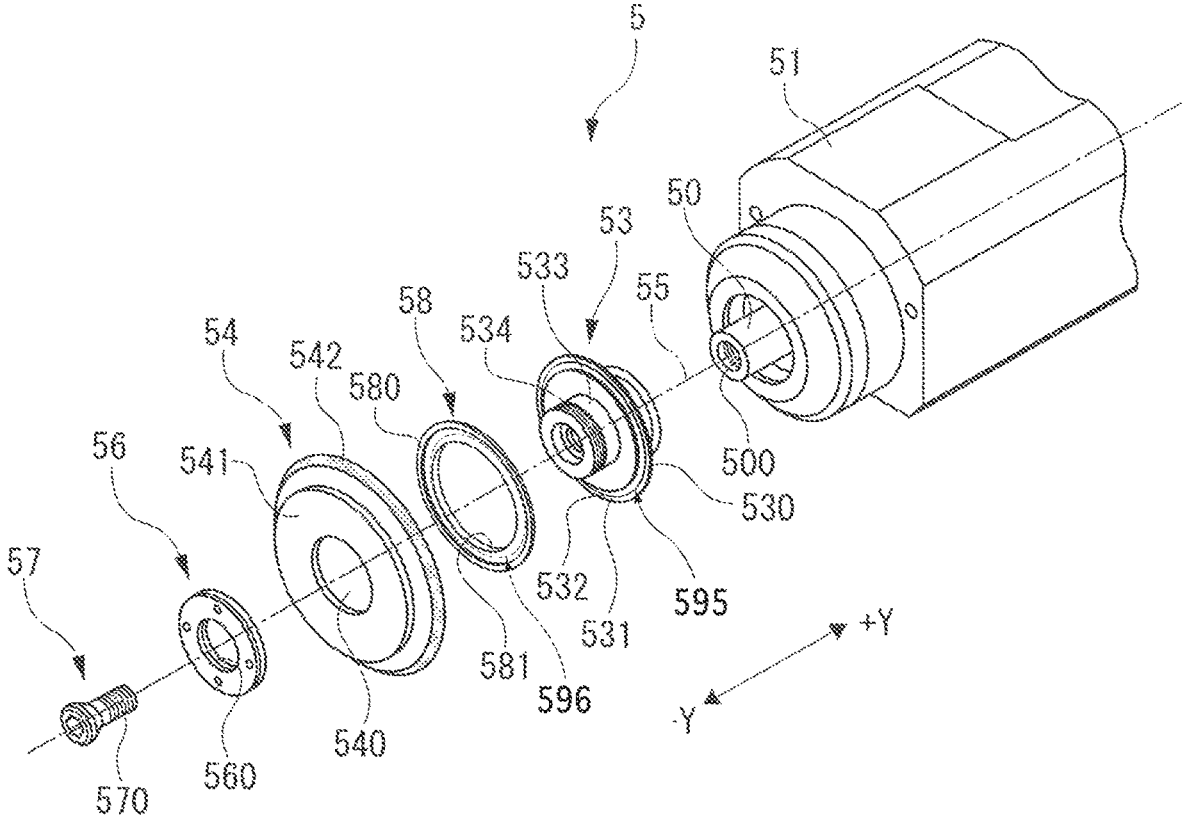
FIG. 10 is an explosive perspective view of a cutting unit of the cutting apparatus, similar to FIG. 2, except FIG. 10 includes a magnetic member on the ring mount and a magnet on the mount base.
Figure 11:
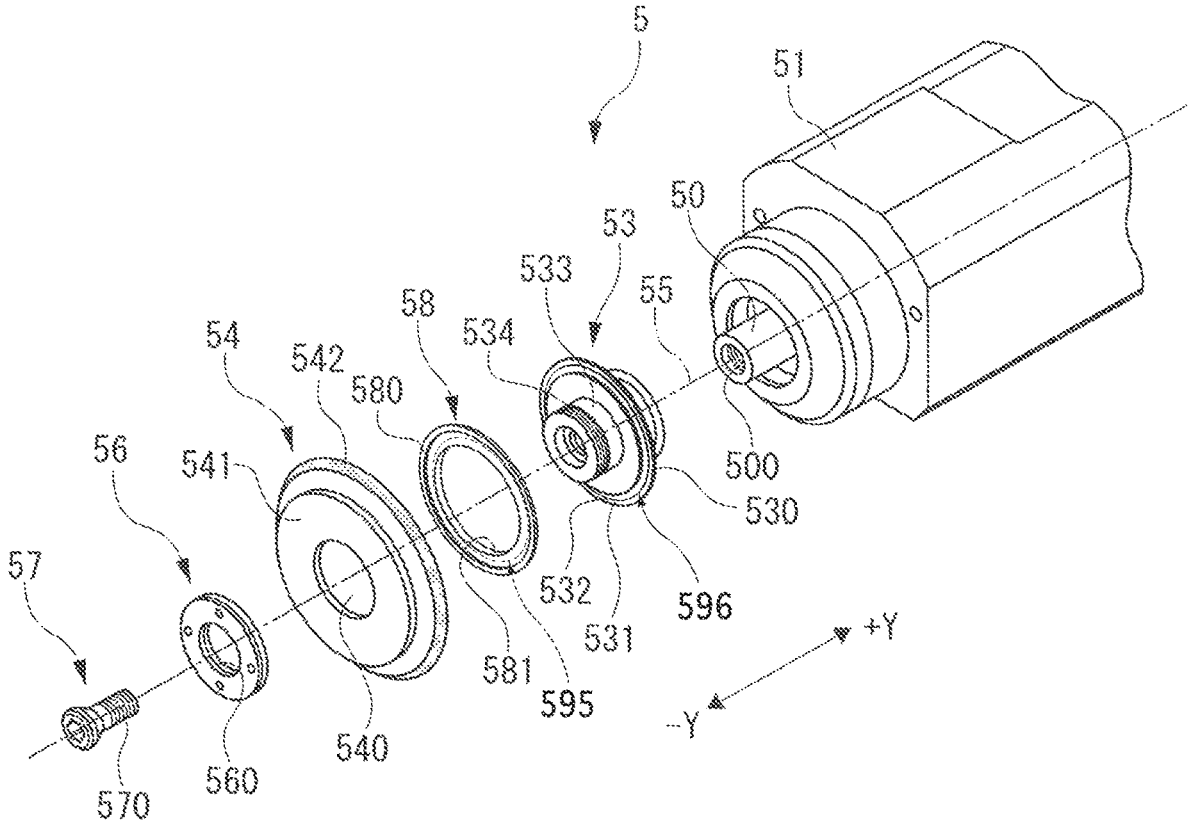
FIG. 11 is an explosive perspective view of a cutting unit of the cutting apparatus, similar to FIG. 2, except FIG. 11 includes a magnet on the ring mount and a magnetic member on the mount base.
Figure 12:
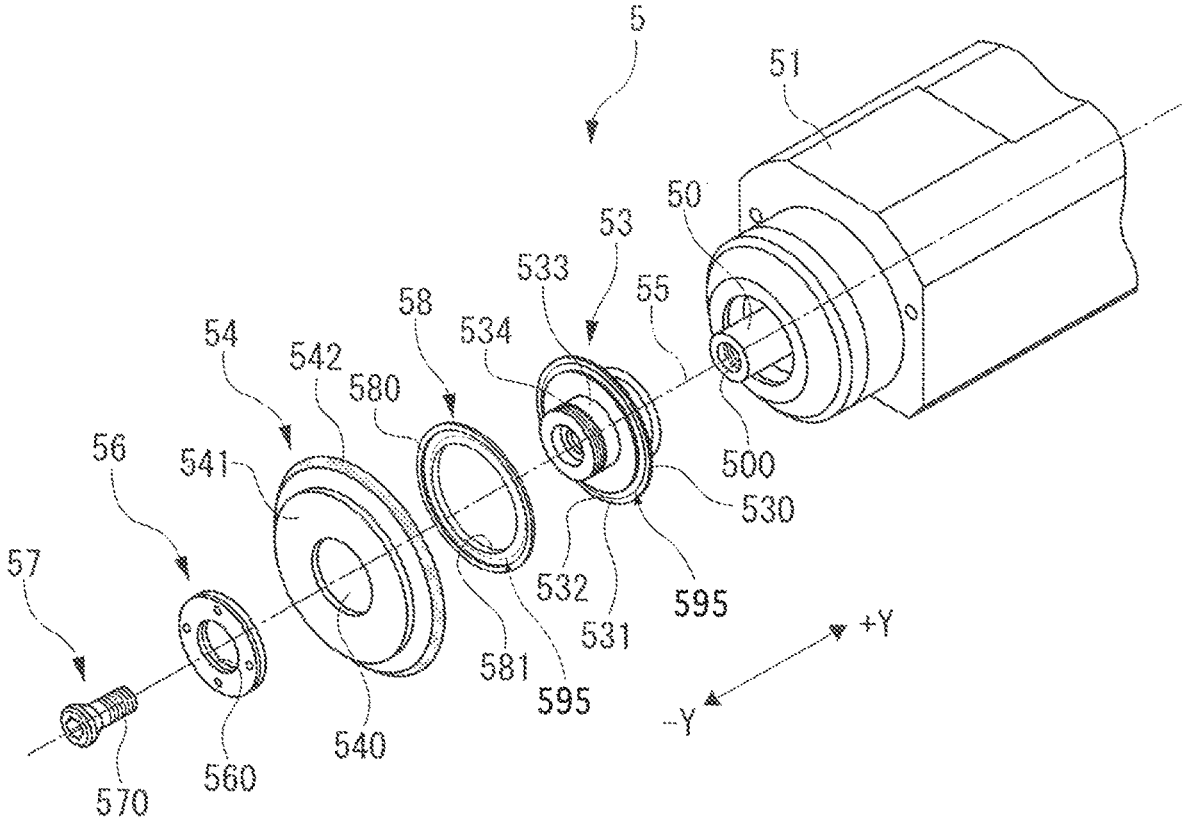
FIG. 12 is an explosive perspective view of a cutting unit of the cutting apparatus, similar to FIG. 2, except FIG. 12 includes a first magnet member on the ring mount and a second magnet on the mount base.

The coupling mechanism 59 may still further be replaced with another coupling mechanism including a magnet, not depicted, disposed on either the ring mount 58 or the mount base 53, and a magnetic member, not depicted, disposed on either the mount base 53 or the ring mount 58 that is free of a magnet, or including magnets, not depicted, disposed respectively on the ring mount 58 and the mount base 53, the magnets and the magnetic members being at such positions where they can magnetically attract each other, such as shown in FIGS. 10-12, which show various combinations of a magnetic member 596 and/or one or more magnetics 595.

For example, a magnet 595 may be disposed on the ring mount 58 illustrated in FIG. 211, and a magnetic member 596 may be disposed on the coupling surface 532 of the mount base 53. Alternatively, as shown in FIG. 10, a magnet 595 may be disposed on the coupling surface 532 of the mount base 53, and a magnetic member 596 may be disposed on the ring mount 58. Further alternatively, as shown in FIG. 12, magnets 595 may be disposed respectively on the ring mount 58 and the coupling surface 532 of the mount base 53. According to these configurations, the ring mount 58 can be coupled to the mount base 53 under magnetic forces.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a chuck table for holding a workpiece thereon; and a cutting unit, on which a hub blade can be mounted, for cutting the workpiece held on the chuck table, the hub blade having an annular base with an opening defined centrally therein and an annular grindstone fixed to an outer circumferential edge of the annular base, wherein the cutting unit includes:

a spindle, a mount base fixed to a distal end of the spindle and having an annular coupling face extending around an axis of the spindle and external threads on a distal end portion of the mount base, a ring-shaped ring mount having an annular support surface supporting a supported face of the annular base of the hub blade, wherein the ring mount is removably coupled to the coupling face of the mount base such that the ring mount is positioned between the coupling face of the mount base and the supported face of the hub blade, a coupling mechanism coupling the ring mount to the coupling face of the mount base, and a nut threaded over the external threads of the mount base, and the annular base of the hub blade is sandwiched in place between the nut threaded over the external threads of the mount base and the ring mount.

2. The cutting apparatus according to claim 1, wherein the coupling mechanism includes:

a pin including a neck projecting from the coupling face of the mount base in an axial direction of the spindle and a head disposed on a distal end of the neck, a hole defined in the ring mount for receiving the head of the pin inserted therein, and an arcuate oblong hole defined in the ring mount for receiving the neck of the pin inserted therein to allow the ring mount and the mount base to turn relatively to each other around the axis of the spindle with the pin inserted in the hole and the arcuate oblong hole, the arcuate oblong hole extending from the hole in a direction along which the ring mount is angularly movable with respect to the mount base, the arcuate oblong hole having a width smaller than a diameter of the hole, and the mount base and the ring mount are coupled to each other by inserting the pin into the hole defined in the ring mount and angularly moving the ring mount and the mount base relatively to each other.

3. The cutting apparatus according to claim 1, wherein the coupling mechanism includes:

a magnet disposed on either the ring mount or the mount base, and a magnetic member disposed on either the mount base or the ring mount that is free of a magnet, and the ring mount is coupled to the mount base under magnetic forces.

4. The cutting apparatus according to claim 1, wherein the coupling mechanism includes:

magnets disposed respectively on the ring mount and the mount base, and the ring mount is coupled to the mount base under magnetic forces.

5. The cutting apparatus according to claim 1, wherein the coupling mechanism includes:

an inner wall support supporting an annular inner circumferential wall surface of the ring mount, and the ring mount is coupled to the coupling face of the mount base by the inner wall support.

* * * * *